US005919741A

United States Patent [19]

Jaynes et al.

[11] Patent Number: 5,919,741

[45] Date of Patent: Jul. 6, 1999

[54] OVERBASED CARBOXYLATE GELS

[75] Inventors: Scot E. Jaynes, Chardon; William R. Sweet, Cleveland Heights, both of Ohio

[73] Assignee: The Lubrizol Corporation, Wickliffe, Ohio

[21] Appl. No.: 09/009,658

[22] Filed: Jan. 20, 1998

[51] Int. Cl.[6] ..... C10M 105/22; C10M 159/20

[52] U.S. Cl. ..... 508/460

[58] Field of Search ..... 508/460

[56] References Cited

U.S. PATENT DOCUMENTS

| | | | |
|---|---|---|---|
| 3,242,079 | 3/1966 | McMillen | 252/33 |
| 3,372,115 | 3/1968 | McMillen | 508/460 |
| 3,816,310 | 6/1974 | Hunt | 252/32.7 HC |
| 4,057,504 | 11/1977 | Shiga et al. | 508/460 |
| 5,300,242 | 4/1994 | Nichols et al. | 252/38 |
| 5,401,424 | 3/1995 | Vinci et al. | 252/18 |
| 5,501,807 | 3/1996 | Benda et al. | 252/18 |
| 5,508,331 | 4/1996 | Nichols et al. | 524/313 |

FOREIGN PATENT DOCUMENTS

| | | |
|---|---|---|
| 1289003 | 9/1972 | United Kingdom . |

*Primary Examiner*—Ellen M. McAvoy
*Attorney, Agent, or Firm*—Krishna G. Banerjee; David M. Shold

[57] ABSTRACT

The present invention is directed to a process for preparing a gelled overbased calcium carboxylate which involves carbonating a carboxylic acid of 8 to 30 carbon atoms in the presence of a promoter system consisting of water and an alcohol of 1 to 8 carbon atoms, such that the mole ratio of alcohol to water is substantially constant and is such that the viscosity of the reaction mixture during carbonation step does not exceed 1 pascal second (1000 centipoise). This process prevents excessive thickening of the reaction mixture in a manufacturing unit during carbonation and affords ample time to complete the process of carbonation without premature crystallization of the calcium carbonate formed during overbasing.

21 Claims, No Drawings

OVERBASED CARBOXYLATE GELS

BACKGROUND OF THE INVENTION

The present invention relates to a process for preparing gelled overbased materials and to coatings and other substances containing such gelled overbased materials.

Overbased additives have been known for a long time. They have been used extensively as industrial lubricants in engines, gears and other industrial applications. Specifically they have been used as detergents, extreme pressure and antiwear agents, anticorrosion and antirust additives, and as rheology control agents in coatings. They are metal salts of acidic organic compounds. Overbased materials are single phase, homogenous, and generally apparently Newtonian systems characterized by a metal content in excess of that which would be present according to the stoichiometry of the metal and the particular acidic organic compound reacted with the metal. They can be converted from their original Newtonian form to a gelled form by a variety of treatments.

U.S. Pat. No. 5,501,807, Benda et al., Mar. 26, 1996 discloses a process for producing basic calcium carboxylic acid salts which includes carbonating a mixture of a $C_7$ to $C_{15}$ carboxylic acids which are preferably branched chain oxo-acids and excess calcium at from 15° to 60° C., in the presence of a volatile solvent.

U.S. Pat. No. 5,300,242 Nichols et al., Apr. 5, 1994 discloses a metal overbased composition prepared by reacting (A) at least one epoxidized natural oil having an oxirane oxygen content of at least 3%, wherein said natural oil is a vegetable oil comprising a triglyceride of the formula

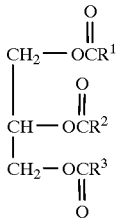

wherein $R^1$, $R^2$ and $R^3$ are unsaturated aliphatic hydrocarbyl groups containing from about 8 to 22 carbon atoms with (B) a metal base oxide (MO), hydroxide (MOH) or alkoxide ($R^4OM$) wherein the metal comprises an alkali or alkaline earth and $R^4$ is a hydrocarbyl group containing from about 1 to about 24 carbon atoms, in an equivalent ratio of (A):(B) from 0.90–10:1 to from a saponified intermediate, adding 2–11 equivalents of (B) per equivalent of said saponified intermediate and reacting excess (B) with (C) carbon dioxide.

U.S. Pat. No. 5,508,331, Nichols et al., Apr. 16, 1996, discloses a heat stabilized PVC composition comprising PVC and a metal overbased composition, wherein the metal overbased composition is prepared by reacting (A) at least one vegetable oil comprising a triglyceride of the formula

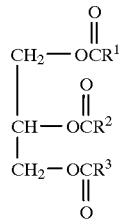

wherein $R^1$, $R^2$ and $R^3$ are independently saturated or unsaturated aliphatic hydrocarbyl groups containing from about 8 to 24 carbon atoms with (B) a metal base oxide (MO), hydroxide (MOH) or alkoxide ($R^4OM$) wherein the metal comprises an alkali or alkaline earth and $R^4$ is a hydrocarbyl group containing from about 1 to about 24 carbon atoms, and wherein the equivalent ratio of (A):(B) is from 1.33–10:1 to from a saponified intermediate, adding 2–11 equivalents of (B) per equivalent of formed saponified intermediate and reacting excess (B) with (C) an acidic gas comprising carbon dioxide, sulfur dioxide or sulfur trioxide.

U.S. Pat. No. 3,816,310, Hunt, Jun. 11, 1974, discloses a method of preparing highly basic, metal containing grease and rust inhibiting compositions which is carried out by (1) forming an admixture of an oil-soluble dispersing agent, an alcohol, water, and an alkaline earth metal oxide, hydroxide, or lower alkoxide; (2) carbonating the admixture to form the alkaline earth metal carbonate; and (3) heating the mixture in a controlled manner to effect a modification reaction in which the grease or rust inhibiting composition is formed as evidenced by a rapid change in the viscosity of the mixture. In an alternative embodiment of the method the water is added after the carbonation step and prior to the heating step.

SUMMARY OF THE INVENTION

A process for preparing a gelled calcium overbased carboxylate, comprising the steps of:

I) treating a carboxylic acid of 8 to 30 carbon atoms or a reactive equivalent thereof with an excess of a calcium base selected from the group consisting of calcium oxide and calcium hydroxide in the presence of an organic solvent in which the equivalent ratio of the calcium base to the carboxylic acid is between 2:1 and about 10:1;

II) carbonating the mixture of (I) at a temperature of 50° C. to 100° C. in presence of a promoter system comprising water and an alcohol of 1 to 8 carbon atoms, wherein the amount of said alcohol is adjusted throughout the carbonation step such that the mole ratio of alcohol to water is substantially constant, said ratio being such that the viscosity of the mixture of (II) does not exceed 1 pascal second (1000 centipoise) during the carbonation step; provided that when the calcium base is calcium hydroxide, the amount of said alcohol is adjusted throughout the carbonation step to maintain said viscosity of the mixture of (II) under about 1 pascal second (1000 centipoise) during the carbonation step;

III) thereafter gelling the mixture of (II) at a temperature of about 25° C. to about 110° C. in the presence of said alcohol and water, by the further addition of water and said alcohol, there being no stripping operation between the carbonation and gelation steps; and optionally IV) removing the alcohol and water.

DETAILED DESCRIPTION OF THE INVENTION

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

Gelled overbased materials are well known materials. Overbasing, also referred to as superbasing or hyperbasing, is a means for supplying a large quantity of basic material in a form which is soluble or dispersable in oil. Overbased products have been long used in lubricant technology to provide detergent additives.

Overbased materials are single phase, homogeneous systems characterized by a metal content in excess of that which would be present according to the stoichiometry of the metal and the particular acidic organic compound reacted with the metal. The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. The basic salts of the present invention often have a metal ratio of 1.5 to 30, preferably 3 to 15, and more preferably 4 to 10.

Overbased materials are generally prepared by reacting an acidic material, normally an acidic gas such as $SO_2$ or $CO_2$, and most commonly carbon dioxide, with a mixture comprising an acidic organic compound, a reaction medium normally comprising an oleo-philic medium, a stoichiometric excess of a metal base, and preferably a promoter.

The oleophilic medium used for preparing and containing overbased materials will normally be an inert solvent for the acidic organic material. The oleophilic medium can be an oil or an organic material which is readily soluble or miscible with oil. The organic material can include an organic solvent which can include both aliphatic and aromatic organic solvents and mixtures thereof. In one embodiment, the organic solvent comprises such materials as mineral spirits and Stoddard Solvent. Mineral Spirits is often referred to as Heavy Naphtha. It has high flash point and solvent power and is extensively used in metal cleaning. Stoddard solvent is a type of mineral spirits which, because of its good odor and high flash is especially used for dry cleaning and is quite generally used in metal cleaning. It is defined in ASTM D-484-52 as a petroleum distillate free from suspended matter and undissolved water, and free from rancid and objectionable odor.

Suitable aromatic solvents include benzene, alkylbenzenes, high flash solvent naphtha, and mixtures thereof. Alkylbenzene includes toluene, xylenes and ethylbenzene as well as benzene rings having different alkyl groups attached thereto, such as methyl ethyl benzene, and mixtures thereof. In one embodiment, the aromatic solvent is SC 100 solvent, which is made up almost entirely of aromatics, comprising mostly high boiling toluenes.

The carboxylic acid of the present invention can include both saturated and unsaturated carboxylic acid of 8 to 30 carbon atoms or reactive equivalents of said carboxylic acids. The phrase "reactive equivalent" of a material means any compound or chemical composition other than the material itself which reacts or behaves like the material itself under the reaction conditions. Thus reactive equivalents of carboxylic acids will include acid-producing derivatives such as anhydrides, alkyl esters, triglycerides, acyl halides, lactones and mixtures thereof unless specifically stated otherwise. It is to be noted that a reactive equivalent of a carboxylic acid as aforementioned, such as a triglyceride, may itself contain carbon atoms in excess of the preferred range of 8–30 in that the triglyceride has three ester functionalities formed by reacting three moles of a carboxylic acid with one mole of glycerol. The range of carbon numbers given above therefore refers only to the carboxylic acid, and not to the total carbon atoms of any reactive equivalent.

Examples of useful carboxylic acids include but are not limited to caprylic acid, capric acid, lauric acid, myristic acid, myristoleic acid, decanoic acid, dodecanoic acid, pentadecanoic acid, palmitic acid, palmitoleic acid, margaric acid, stearic acid, 12-hydroxystearic acid, oleic acid, ricinoleic acid, linoleic acid, linoleic acid, arachidic acid, gadoleic acid, eicosadienoic acid, behenic acid, erucic acid, mixtures of any of these acids or their reactive equivalent.

The carboxylic acid or its reactive equivalent can also comprise at least one natural oil comprising an animal oil or vegetable oil comprising a triglyceride of the formula

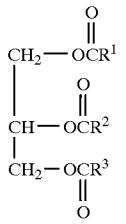

wherein $R^1$, $R^2$ and $R^3$ are independently hydrocarbyl groups containing 7 to 29 carbon atoms. Examples of suitable vegetable oils include coconut oil, soybean oil, rapeseed oil, sunflower oil, including high oleic sunflower oil, lesquerella oil and castor oil. In a preferred embodiment, the vegetable oil is coconut oil.

The calcium base of the present invention is selected from the group consisting of calcium oxide (CaO) and calcium hydroxide ($Ca(OH)_2$).

When the carboxylic acid present in the form of a reactive equivalent such as a triglyceride is initially reacted together with the calcium base, hydrolysis of the triglyceride takes place to form a saponified intermediate.

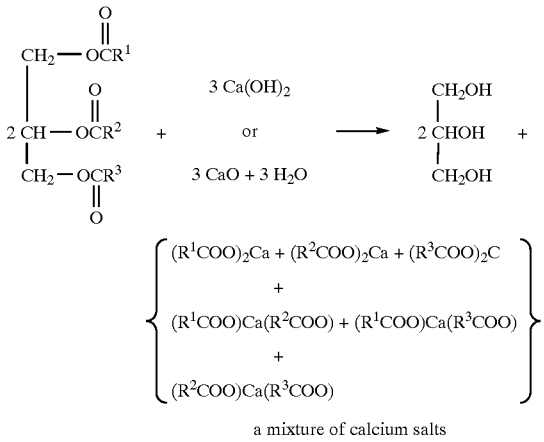

The equivalent ratio of the calcium base to the carboxylic acid is between 2:1 and 10:1; thus sufficient calcium base is present to effect saponification quantitatively (i.e. 100%). When the saponified intermediate is obtained, glycerol is also formed. It is important to note that this system differs from the prior art in that no free glycerol is added at the beginning of the saponification reaction. The glycerol formed, although not considered to be a "promoter" (a term discussed below), can aid in the incorporation of the excess calcium in the overbasing process. It can act as both a diluent and contact agent and remains within the composition. However, the presence of glycerol is not necessary for the present invention. For example, it is possible to use as the carboxylic acid of the present invention directly the acid form of the natural oil rather than the natural oil itself (in the form of a triglyceride). Thus, it is possible to use coconut acid itself as well as coconut oil.

The carbonation of the mixture of (I) takes place through the use of carbon dioxide, an acidic gas. The amount of carbon dioxide which is used depends in some respects upon the desired basicity of the product in question and also upon the amount of calcium base employed, which as discussed above will vary (in total amount) from 2–10 equivalents per equivalent of carboxylic acid. The carbon dioxide is generally blown below the surface of the reaction mixture of (I) along with additional (i.e., amounts in excess of what is required to convert the carboxylic acid quantitatively to the calcium carboxylate salt) calcium base after the calcium carboxylate intermediate is formed. The calcium carboxylate intermediate is formed either from direct reaction of the carboxylic acid with the calcium base or through saponification of a reactive equivalent of the carboxylic acid, such as a triglyceride. The process of carbonation which is a part of the process of overbasing is well known to those skilled in the art. The carbon dioxide employed during the carbonation step is used to react with the excess calcium base which may be already be present or which can be added during the carbonation step. The mixtures of products obtained after carbonation are referred to herein as overbased materials of this invention which include calcium carbonate formed from the reaction of carbon dioxide and calcium hydroxide.

The carbonation is carried out in the presence of a promoter. Promoters are chemicals which can be employed in the overbasing process to facilitate the incorporation of the large excess metal into the overbased compositions. Typical examples of promoters used in overbasing include water; phenolic materials such as phenol; alcohols of various kinds, such as methanol, 2-propanol, the butyl alcohols, the amyl alcohols, as well as mixtures of alcohols; monoglycerides; di-glycerides; and amines such as aniline and dodecyl amine. The promoter system used in the present invention consists of a mixture of water and an alcohol of 1 to 8 carbon atoms. The alcohol can preferably be selected from the group consisting of 2-propanol (isopropyl alcohol), 1-butanol, and 2-methyl-1-propanol (isobutyl alcohol). In a more preferred embodiment, the alcohol is 2-methyl-1-propanol.

The carbonation reaction can be carried out at a temperature of 50° C. to 100° C. A practical temperature limitation in a carbonation reaction is the boiling point at ambient pressure of a promoter material such as 2-methyl-1-propanol (boiling point 108° C.). In one embodiment the carbonation temperature is 65–90° C., where the alcohol in the water/alcohol promoter system is 2-methyl-1-propanol.

The carbonation step (II) in this invention is carried out in such a way so as to keep the mole ratio of alcohol to water substantially constant throughout this step. The desired ratio is such that the viscosity of the mixture of (II) does not exceed 1 pascal second (1000 centipoise). Thus the mixture of (II) remains an easy-to-handle nonviscous fluid throughout the carbonation step. Herein lies one unique advantage of the present invention over the prior art. Normally, during overbasing the reaction mixture becomes quite viscous, and this prevents the attainment of a high base number desired from an overbased product having a high metal ratio. The formation of a viscous product, or precipitate, or the settling of the reaction mixture into a solid, considerably limits the use of products made by overbasing. The use of the water/alcohol solvent in the ratios disclosed hereinafter prevents excessive thickening of the reaction mixture during carbonation and also prevents the premature crystallization of the calcium carbonate (formed from the reaction of carbon dioxide with the calcium base). Thus the mixture of (II) remains a nonviscous fluid throughout the carbonation step. By "preventing premature crystallization", it is meant that the desired water/alcohol ratios extend the time needed to crystallize the calcium carbonate to several days or weeks. Thus, the desired water/alcool ratios give ample time to complete carbonation in a manufacturing unit without crystallization. It is important to stress the importance of keeping the reaction medium fluid during carbonation in large scale (at least 600 liters) synthesis, where viscosity plays a very important role for effective and controlled carbonation. In such large scale operations, it is not economical to lower the viscosity of the reaction medium by adding suitable inert solvents or diluents. However by keeping the mole ratio of alcohol to water within the preferred range specified below, acceptable viscosities of the reaction mixture less than 1 pascal second (1000 centipoise) (cP) can be obtained.

The mole ratio of alcohol to water can depend on the precise carboxylic acid substrate that is being overbased, the organic solvent being used for overbasing, the alcohol used in the promoter system, and the calcium base that is being used. When the calcium base is calcium hydroxide, the organic solvent comprises mineral spirits, the alcohol used is 2-methyl-1-propanol, the preferred ratio is 0.2:1 to 1:1, more preferably 0.2:1 to 0.5:1. When the calcium base is calcium oxide, the organic solvent comprises SC-100 solvent, and the alcohol used is 2-methyl-1-propanol, the preferred ratio is 0.5:1 to 1.5:1, more preferably 0.8:1 to 1.2:1.

When the calcium base is calcium oxide, no net amount of water is generated during the carbonation step. The water of the promoter system (water plus alcohol) is used to convert the calcium oxide to calcium hydroxide. The water generated during the carbonation step is used to convert more of the calcium oxide to calcium hydroxide. In this way all the water generated during carbonation is recycled by reacting with the calcium oxide. Thus when calcium oxide is used as the calcium base, the amount of alcohol added as the promoter is typically added all at once at the beginning of the carbonation step. This is to be contrasted with the carbonation process where the calcium base is calcium hydroxide. When calcium hydroxide is used, water that is generated during carbonation is not recycled; as a result the promoter system becomes more enriched in water. Thus, to keep the mole ratio of alcohol to water substantially constant throughout the carbonation step, alcohol has to be added throughout the carbonation step. This addition of alcohol is done incrementally during carbonation and is exemplified in detail in the "Examples" section of this specification.

The third major step in the process of preparing the gelled calcium overbased carboxylates of the present invention involves gelling the mixture of (II). Ungelled overbased materials are normally Newtonian materials which are homogeneous on a macroscopic scale. These ordinary overbased materials can be gelled, i.e. converted into a gel-like or colloidal structure, by homogenizing a "conversion agent" with the overbased starting material.

The terminology "conversion agent" is intended to describe a class of very diverse materials which possess the property of being able to convert the Newtonian homogeneous, single-phase, overbased materials into non-Newtonian colloidal disperse systems. The mechanism by which conversion is accomplished is not completely understood. However, with the exception of carbon dioxide, these conversion agents generally possess active hydrogens. The conversion agents generally include lower aliphatic carboxylic acids, water, aliphatic alcohols, polyethoxylated materials such as polyglycols, cycloaliphatic alcohols, arylaliphatic alcohols, phenols, ketones, aldehydes, amines, boron acids, phosphorus acids, sulfur acids, and carbon dioxide (particularly in combination with water). Mixtures of two or more of these conversion agents are also useful. Particularly useful conversion agents are alcohols having less than twelve carbon atoms while the lower alcohols, i.e., alcohols having less than six carbon atoms, are preferred for reasons of economy and effectiveness in the process.

The use of a mixture of water and one or more of the alcohols is known to be especially effective for converting the overbased materials to colloidal disperse systems and is used as the conversion agent in the instant invention. For the present invention, the preferred alcohols are selected from the group consisting of 2-propanol, 1-butanol, 2-methyl-1-propanol and mixtures thereof, with the most preferred being 2-methyl-1-propanol (isobutanol). Thus the same alcohols used during carbonation can also be used in the gelation step. In one embodiment, a mixture of water and 2-methyl-1-propanol is used in the gelation step.

Gelation is normally achieved by agitation of the conversion agent and the overbased starting materials, preferably at the reflux temperature or a temperature slightly below the reflux temperature. In the present case, although gelation can be carried out at a temperature of 25° C. to 110° C., it takes longer to gel at lower temperatures. Typically, for the present invention gelation is conducted at or slightly below the reflux temperature of the solvent mixture which includes the water and alcohol of the promoter system as well as any other organic solvent used to prepare the overbased material. In one embodiment, the gelation temperature is in the range of 70–90° C., where the alcohol in the water/alcohol conversion agent is 2-methyl-1-propanol. Gelation is started by the further addition of the alcohol and water conversion agent to the carbonated (overbased) reaction mixture, and heating the mixture to the reflux temperature or slightly below the reflux temperature. The process of gelation is well known to those skilled in the art of overbasing. The details of the process are described in U.S. Pat. Nos. 3,492,231; 5,300,242 and 5,508,331. Typical gelation times for the present process employing calcium hydroxide, mineral spirits as the organic solvent and 2-methyl-1-propanol/water mixture as the conversion agent, at about 85–90° C. ranges from 2 to 6 hours.

An important aspect of the present invention is that because the same alcohol or alcohol mixture used during carbonation is used for gelation, there is no stripping operation between the carbonation and the gelation steps. In otherwords, there is no need to remove the alcohol, alcohol mixture or water/alcohol mixture used during carbonation to effect gelation.

In the present invention, because the alcohol used to bring about gelation is the same as the alcohol used in the promoter system, any reference to the concentration of conversion agent will include the amount/concentration of alcohol and water added initially as the promoter. The concentration of the conversion agent necessary to achieve conversion of the overbased material is preferably within the range of 5 to 50 weight %, more preferably 10 to 30 weight % based upon 35–50 weight % overbased material in the organic solvent (this 35–50 weight % range of course excludes any alcohol and water present initially as the promoter). In a preferred embodiment, the concentration of water and 2-methyl-1-propanol before gelation based on total weight of all components are at levels of approximately 3–4% and 5–6% respectively; during gelation these levels are approximately 6–7% and 13–14% respectively.

The gelled material obtained thereby may be used without further treatment. However, it is often desirable to remove the volatile materials, such as water and alcohol conversion agents, from the composition. This can be effected by further heating the composition to 115–200° C. for a sufficient length of time to achieve the desired degree of removal. The heating may be conducted under vacuum if desired, in which case the temperatures and times can be adjusted in a manner which will be apparent to the person skilled in the art.

Removal of volatile materials need not be limited to removal of the conversion agents, however. It is possible, for instance, to completely isolate the solid components of the gelled material as dry or nearly dry solids. (In this context the term "solid" or "solids" includes not only sensibly dry materials, but also materials with a high solids content which still contain a relatively small amount of residual liquid.) Isolation of solids can be effected by preparing the composition in an oleophilic medium which is a volatile organic compound. The term "volatile" as used in this context describes a material which can be removed by evaporation. Xylenes, for example, would be considered volatile organic compounds. Heating of the gel to a suitable temperature and/or subjecting it to vacuum can lead to removal of the volatile oleophilic medium to the extent desired. Typical methods of drying include bulk drying, vacuum pan drying, spray drying, flash stripping, thin film drying, vacuum double drum drying, indirect heat rotary drying, and freeze drying. Other methods of isolation of the solids can also be employed, and some of those methods do not require that the oleophilic medium be a volatile material. Thus in addition to evaporation, such methods as dialysis, precipitation, extraction, filtration, and centrifugation can be employed to isolate the solid components of the gel.

The solid material thus isolated may be stored or transported in this form and later recombined with an appropriate amount of a medium such as an oleophilic medium (e.g. an oil). The redispersion into oil can be accomplished more readily when the solid material is not dried to absolute dryness, i.e. when a small amount of solvent remains in the composition. Alternatively an appropriate amount of an oil such as a mineral oil, a natural oil such as vegetable oil, e.g., coconut oil or the like, or synthetic oil, or a surfactant, can be present in the nominally dry powder to aid in dispersion. The solid materials, when dispersed in an appropriate medium, can provide a gel, a coating composition, a grease, another lubricant, or any of the materials which can be prepared from the originally gelled material. The solid materials can also be used without redispersion for their intrinsic lubricating properties.

It is also possible to prepare a dispersion of a gel in an oil or in an oleophilic medium different from that in which the gel was originally prepared, i.e., a "replacement medium," by a solvent exchange process. Such an alternative process avoids the necessity of preparing a dried powder and redispersing it in the second, or replacement medium, and thus can eliminate one or more processing steps. The first step in one embodiment of this modified process is the preparation of a gel in a volatile polar, oleophilic medium as described in greater detail above. To this gel is admixed the oil or other material which is desired as the replacement medium. When this replacement medium is significantly less volatile than the original medium, the original medium (along with any other volatile components) can be removed by heating or evaporation or stripping, leaving behind the less volatile replacement medium containing the overbased gel particles. Of course, the two liquid media can be separated by other physical or chemical methods appropriate to the specific combination of materials at hand, which will be apparent to one skilled in the art.

It is also possible to remove the water and alcohol present in the overbased mixture and add a diluent (such as an oil or organic solvent) which may be the same or different from the diluent used during overbasing.

The processes and compositions of the present invention can be used to prepare a variety of materials useful as additives for coating compositions, as stabilizing agents or additives for such compositions as polymeric compositions or for drilling muds or other down-hole oil field applications, as rheology control agents for water solutions, such as paints and invert emulsions, as lubricants (including greases) for oil field, automotive, steel mill, mining, railroad, and environmentally friendly applications, as lubricants for food-grade applications, metalworking, and preservative oils, as lubricants for abrasives (grinding aids), as a component of synthetic based invert lubricants, and in thermal stabilizer compositions for polymers such as polyvinyl chloride resin.

In one embodiment, the overbased material prepared by the process of this invention can be used in a lubricant composition comprising the overbased material and an oil of lubricating viscosity including natural or synthetic lubricating oils and mixtures thereof. Natural oils include animal oils, vegetable oils, mineral oils, solvent or acid treated mineral oils, and oils derived from coal or shale. Synthetic lubricating oils include hydrocarbon oils, halo-substituted hydrocarbon oils, alkylene oxide polymers, esters of carboxylic acids and polyols, esters of polycarboxylic acids and alcohols, esters of phosphorus-containing acids, polymeric tetrahydrofurans, silicone-based oils and mixtures thereof.

Specific examples of oils of lubricating viscosity are described in U.S. Pat. No. 4,326,972 and European Patent Publication 107,282. A basic, brief description of lubricant base oils appears in an article by D. V. Brock, "Lubricant Base Oils," *Lubricant Engineering*, volume 43, pages 184–185, March 1987. A description of oils of lubricating viscosity occurs in U.S. Pat. No. 4,582,618 (Davis) (column 2, line 37 through column 3, line 63, inclusive). Another source of information regarding oils used to prepare lubricating greases is *NLGI Lubricating Grease Guide*, National Lubricating Grease Institute, Kansas City, Mo. (1987), pp 1.06–1.09.

In a preferred embodiment, the overbased material prepared by the process of this invention can be used in a coating composition as a rheology control agent. Coating compositions include paints, certain inks, and various varnishes and lacquers. They often contain pigments in a dispersing medium or vehicle, a film-forming organic polymer, and other conventional additives known to those skilled in the art. These include additives for microbiological control (bactericides and fungicides), additives for fire retardance, additives that are inhibitors for flash rusting and can corrosion, anti-gassing agents, additives for surface lubrication and mar and scuff resistance, anti-static agents, deodorants, and tannin stain suppressants.

Drilling fluid or mud used in oil-field applications functions principally to carry chips and cuttings produced by drilling to the surface; to lubricate and cool the drill bit and drill string; to form a filter cake which obstructs filtrate invasion in the formation; to maintain the walls of the borehole; to control formation pressures and prevent lost returns; to suspend cuttings during rig shutdowns; and to protect the formation for later successful completion and production. Drilling fluids or muds are preferably able to suspend cuttings and weighting materials upon stopping of circulation of the drilling fluid. It is further desirable to have drilling fluids or muds which maintain thixotropy and rheology during operation and even in compositions with increased solids. Other oil-field materials in which the materials of the present invention can be employed include enhanced oil recovery fluids, fracturing fluids, spotting fluids, fluid loss materials, and cementing materials.

Greases are a class of lubricants which are generally viscous materials containing an oil of lubricating viscosity and a thickening agent, as well as additional customary additives. The materials prepared by the present invention are useful as thickening agents for such greases; they can also provide corrosion and extreme pressure antiwear protection, which is normally supplied by the use of supplemental additives.

EXAMPLES

Example 1

Saponification of Coconut Oil with Lime in Mineral Spirits

A reactor is charged with 1725 grams of mineral spirits. The reactor is heated to 32.2° C. (90° F.), and then 1254 grams (5.75 equivalents) of coconut oil is charged to the reactor. The alcohol 2-methyl-1-propanol (isobutanol; 148 grams; 2 moles) is then charged, followed by water (24 grams; 1.33 moles). Lime ($Ca(OH)_2$; 223 grams; 6.03 equivalents) is then added and the contents are begun to be stirred. The contents of the reactor are heated to 99°–110° C. (210°–230° F.) with stirring and held at that temperature until a base number (phenolphthalein) of 4.7–14.1 is reached. The product obtained is saponified coconut oil (calcium carboxylate of coconut acid) in mineral spirits.

Example 2

Carbonation of Coconut Oil with Lime in Mineral Spirits

To the mixture of Example 1 is added 2104 grams of mineral spirits. This cools the reaction mixture to 92° C. (200° F.). Then carbonation is carried out in seven increments. Each increment of carbonation includes 155 grams (4.19 equivalent) of lime and blowing of carbon dioxide into the reaction mixture. In each increment, the lime is initially allowed to mix thoroughly with the reaction mixture before carbon dioxide is bubbled into the mixture. Carbon dioxide is initially bubbled slowly into the reaction mixture and then the rate is increased. The approximate time for carbonation per increment is 3 hours. About 30 grams of $CO_2$ is used per hour during each increment. Starting in the second increment and continuing in subsequent increments, 2-methyl-1-propanol (54 grams; 0.73 mole) is charged (this corresponds approximately to 0.35 mole of 2-methyl-1-propanol per mole of water generated in the increment), followed by 155 g of lime and bubbling of carbon dioxide in the manner disclosed in preceding sentences. The carbonation step is repeated in each increment. The mixture is cooled as needed to keep the rate of bubbling of $CO_2$ at a maximum while not allowing the overbased calcium carboxylate to freeze. (At a temperature above 95° C., $CO_2$ simply blows through the reaction mixture and is not absorbed by the lime to produce calcium carbonate, while at a temperature of about 50° C., the overbased calcium carboxylate freezes; it is therefore important to maintain the temperature at about 55–90° C., so that carbon dioxide can be blown at a rate sufficiently high that it can actually be absorbed by the lime while not allowing the overbased carboxylate to freeze). At the end of the seventh and final increment of carbonation, $CO_2$ is continued to be bubbled to a base number (phenolphthalein) of about 4–7. The temperature at the end of this carbonation procedure is about 70° C. The mixture at this point is an overbased (but not gelled) calcium carboxylate in mineral spirits.

Example 3

Gelation of Overbased Coconut Oil in Mineral Spirits

To the mixture of Example 2 is charged 506 grams of 2-methyl-1-propanol and 189 grams of water. The mixture is heated to 82.2° C. (180° F.). The process is monitored by infrared spectroscopy by monitoring the shift of an absorbance peak from approximately 864 $cm^{-1}$ to 877 $cm^{-1}$ indicative of change to crystalline carbonate from amorphous carbonate. About 1416 grams of mineral spirits are added when about 80% of total carbonate is converted to the crystalline form (as determined by the IR peaks at 864 and 877 $cm^{-1}$). Another 2192 grams of mineral spirits are added when 90–100% of the carbonate is converted from the amorphous to the crystalline form. The reaction mixture at this point is a gelled overbased calcium carboxylate.

Example 4

Stripping of Gelled Overbased Coconut Oil in Mineral Spirits

The reaction mixture of Example 3 is heated to 126.7° C. (260° F.) to remove the water and 2-methyl-1-propanol. About 1949 grams of distillate is recovered. About 1356 grams of mineral spirits is added to adjust the level of solids to about 25% (i.e. 25% solids, 75% liquids).

Example 5

Variation of Viscosity with Alcohol to Water Mole Ratio During Carbonation

The following table shows the effect of the mole ratio of alcohol to water on the viscosity of the reaction mixture during carbonation. The material being carbonated is saponified coconut oil in mineral spirits, $Ca(OH)_2$ is used as the calcium base for saponification; and the alcohol used is 2-methyl-1-propanol.

| 2-Methyl-1-Propanol:Water mole ratio | Viscosity (Pa.s × $10^3$) |
|---|---|
| 0.16:1 | 115,000 |
| 0.18 | >4000 |
| 0.19 | 32 |
| 0.30 | 5 |
| 0.98 | 5 |
| 1.16 | 1320 |
| 1.29 | 5340 |

These carbonations were carried out in 5 liter size reactors with a slow (less than 350 rpm) stirring speed. The table shows that for the system used (saponified coconut oil in mineral spirits as substrate; 2-methyl-1-propanol/water as the promoter system), there is a narrow range of alcohol:water ratio of approximately 0.18–1.1:1 when the viscosity of the reaction mixture is fairly low (less than 1 pascal second (Pa.s), or 1000 centipoise (cP)). Outside this range, the viscosities are fairly high, and the reaction mixture is difficult to handle.

Example 6

Saponification of Coconut Oil with Quick Lime in Aromatic Solvent

A reactor is charged with 915 grams of SC-100 solvent. The reactor is heated to 32° C. (90° F.), and then 665 grams (3.05 equivalents) of coconut oil is charged to the reactor. 2-methyl-1-propanol (146 grams; 1.97 moles) is then charged, followed by water (110 grams; 12.22 moles). Quick lime (CaO; 102 grams; 3.64 equivalents) is then added and the contents are begun to be stirred. The contents of the reactor are heated to 99°–110° C. (210°–230° F.) with stirring and held at that temperature until a base number (phenolphthalein) of 17–27 is reached. The product obtained is saponified coconut oil (calcium carboxylate of coconut acid) in SC-100 solvent.

Example 7

Carbonation of Coconut Oil with Quick Lime in Aromatic Solvent

To the mixture of Example 6 are added 938 grams of SC-100 solvent, 79 grams of quick lime (CaO; 2.82 equivalents.), and 61 grams of 2-methyl-1-propanol (0.82 moles) while cooling the reaction mixture to 82° C. (180° F.). This results in a mixture having an alcohol/free water molar ratio of approximately 1/1. The balance of the quick lime (CaO; 352 grams; 12.57 equivalents) needed for overbasing is charged to a covered, nitrogen-blanketed solids hopper which uses a screw feeder to continuously deliver the quick lime to the reactor. The screw feeder is started and adjusted to deliver quick lime to the reactor at the rate of 14 grams/hour. Carbon dioxide is simultaneously bubbled slowly into the reaction mixture at the rate of 11 grams/hour so as to maintain a base number (phenolphthalein) of approximately 65. The mixture is carbonated at 70° C.–82° C. (158° F.–180° F.). (At a temperature above 95° C., $CO_2$ simply blows through the reaction mixture and is not absorbed by the hydrated quick lime to produce calcium carbonate, while at a temperature of about 50° C., the overbased calcium carboxylate freezes; it is therefore important to maintain the temperature at about 55–90° C.). After about 25 hours all the quick lime has been charged to the reactor. $CO_2$ is continued to be bubbled for about six more hours to a base number (phenolphthalein) of about 4–7, and two 66 gram charges of 2-methyl-1-propanol (1.78 equivalents total) are added to the mixture at 2 hours and at 4 hours after the end of the quick lime addition in order to maintain an approximate alcohol/free water molar ratio of 1/1. The mixture at this point is an overbased (but not gelled) calcium carboxylate in aromatic solvent.

Example 8

Gelation of Overbased Coconut Oil in Aromatic Solvent

To the mixture of Example 7 is charged 800 grams of SC-100 solvent, 344 grams of 2-methyl-1-propanol and 259 grams of water. The mixture is heated to 88° C. (190° F.). The process is monitored by infrared spectroscopy by monitoring the shift of an absorbance peak from approximately 864 $cm^{-1}$ to 877 $cm^{-1}$ indicative of change to crystalline carbonate from amorphous carbonate. About 1300 grams of SC-100 solvent is added when about 80% of total carbonate is converted to the crystalline form (as determined by the IR peaks at 864 and 877 $cm^{-1}$). When 90–100% of the carbonate is converted from the amorphous to the crystalline form, the reaction mixture at this point is a gelled overbased calcium carboxylate.

Example 9

Stripping of Gelled Overbased Coconut Oil in Aromatic Solvent

The reaction mixture of Example 8 is heated to 126° C. (260° F.) to remove the water and 2-methyl-1-propanol. About 800 grams of SC-100 solvent is added during this process to lower viscosity. About 2435 grams of distillate is recovered. About 1400 grams of SC-100 solvent is added to adjust the level of solids to about 25% (i.e. 25% solids, 75% liquids).

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. It is to be understood that the amount, range, and ratio limits set forth herein may be combined. As used herein, the expression "consisting essentially of" permits the inclusion of substances which do not materially affect the basic and novel characteristics of the composition under consideration.

What is claimed is:

1. A process for preparing an overbased calcium carboxylate gel, comprising the steps of:

I) Treating a saturated carboxylic acid of about 8 to about 30 carbon atoms or a reactive equivalent thereof with an excess of a calcium base selected from the group consisting of calcium oxide and calcium hydroxide in the presence of an organic solvent wherein the equivalent ratio of the calcium base to the carboxylic acid is about 2:1 to 10:1;

II) Carbonating the mixture of (I) at a temperature of about 50° C. to about 100° C. in presence of a promoter system comprising water and an alcohol of 1 to 8 carbon atoms, such that the mole ratio of alcohol to water is substantially constant, said ratio being such that the viscosity of the mixture of (II) does not exceed about 1000 centipoise during the carbonation step; provided that when the calcium base is calcium hydroxide, the amount of said alcohol is adjusted throughout the carbonation step to maintain said viscosity of the mixture of (II) under about 1000 centipoise during the carbonation step;

III) Thereafter gelling the mixture of (II) at a temperature of about 25° C. to about 110° C. in the presence of said alcohol and water, by the further addition of water and said alcohol, there being no stripping operation between the carbonation and gelation steps; and optionally (IV) Removing the alcohol and water.

2. The process of claim 1 further comprising a step V) of adding a diluent after step IV).

3. The process of claim 1 wherein the saturated carboxylic acid is a coconut acid, hydrogenated palmitic acid, hydrogenated castor acid, stearic acid, 12-hydroxystearic acid, or 14-hydroxyarachidic acid.

4. The process of claim 1 wherein the carboxylic acid or a reactive equivalent thereof comprises at least one natural oil comprising an animal oil or vegetable oil comprising a triglyceride of the formula

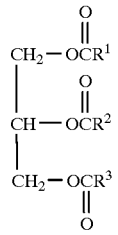

wherein $R^1$, $R^2$ and $R^3$ are independently saturated hydrocarbyl groups containing about 8 to about 30 carbon atoms.

5. The composition of claim 4 wherein the vegetable oil is coconut oil.

6. The process of claim 1 wherein the organic solvent comprises mineral spirits.

7. The process of claim 1 wherein the organic solvent comprises an aromatic solvent.

8. The process of claim 7 wherein the aromatic solvent comprises alkylbenzenes and mixtures thereof.

9. The process of claim 8 wherein the alkylbenzenes are selected from the group consisting of xylenes, and methyl ethyl benzenes.

10. The process of claim 1 wherein the equivalent ratio of calcium base to carboxylic acid is about 6:1.

11. The process of claim 1 wherein the alcohol is selected from the group consisting of 2-propanol, 1-butanol, 2-methyl-1-propanol and mixtures thereof.

12. The process of claim 11 wherein the alcohol is 2-methyl-1-propanol.

13. The process of claim 6, wherein the calcium base is calcium hydroxide; the alcohol is 2-methyl-1-propanol and the mole ratio of alcohol to water is about 0.2:1 to about 1:1.

14. The process of claim 13 wherein the mole ratio of alcohol to water is about 0.2:1 to about 0.5:1.

15. The process of claim 8 wherein the calcium base is calcium oxide; the alcohol is 2-methyl-1-propanol and the mole ratio of alcohol to water is about 0.5:1 to about 1.5:1.

16. The process of claim 15 wherein the mole ratio of alcohol to water is about 0.8:1 to about 1.2:1.

17. The process of claim 1 wherein the carboxylic acid is a coconut acid; the organic solvent comprises mineral spirits; the calcium base is calcium hydroxide; the equivalent ratio of calcium hydroxide to the coconut acid is about 5:1 to about 7:1; the alcohol is 2-methyl-1-propanol, the mole ratio of alcohol to water is about 0.2:1 to 0.5:1; the carbonation temperature is about 65–90° C., and the gelation temperature is about 70–90° C.

18. The process of claim 1 wherein the carboxylic acid is a coconut acid; the organic solvent comprises an aromatic solvent; the calcium base is calcium oxide; the equivalent ratio of calcium oxide to the coconut acid is about 5:1 to about 7:1; the alcohol is 2-methyl-1-propanol, the mole ratio of alcohol to water is about 0.8:1 to about 1.2:1; the carbonation temperature is about 65–90° C., and the gelation temperature is about 70–90° C.

19. A coating composition comprising an overbased material prepared by the process of claim 1.

20. A lubricant composition comprising an overbased material prepared by the process of claim 1 and an oil of lubricating viscosity.

21. A product prepared by the process of claim 1.

* * * * *